US009074346B2

(12) United States Patent
Ohhigashi et al.

(10) Patent No.: US 9,074,346 B2
(45) Date of Patent: Jul. 7, 2015

(54) WORK MACHINE AND CONTROL METHOD FOR WORK MACHINES

(75) Inventors: Kouji Ohhigashi, Duesseldorf (DE); Noritaka Nagata, Kamakura (JP); Masatoshi Uchimaru, Hirakata (JP)

(73) Assignee: KOMATSU LTD., Tokyo (JP)

( * ) Notice: Subject to any disclaimer, the term of this patent is extended or adjusted under 35 U.S.C. 154(b) by 222 days.

(21) Appl. No.: 13/376,250

(22) PCT Filed: Jun. 8, 2010

(86) PCT No.: PCT/JP2010/059647

§ 371 (c)(1),
(2), (4) Date: Dec. 28, 2011

(87) PCT Pub. No.: WO2010/143616

PCT Pub. Date: Dec. 16, 2010

(65) Prior Publication Data

US 2012/0093624 A1 Apr. 19, 2012

(30) Foreign Application Priority Data

Jun. 12, 2009 (JP) ..... 2009-141436

(51) Int. Cl.
*E02F 9/22* (2006.01)
*F15B 11/16* (2006.01)

(52) U.S. Cl.
CPC ..... *E02F 9/2203* (2013.01); *F15B 11/162* (2013.01); *E02F 9/2228* (2013.01); *E02F 9/2282* (2013.01); *E02F 9/2285* (2013.01); *E02F 9/2292* (2013.01); *E02F 9/2296* (2013.01); *F15B 2211/20546* (2013.01); *F15B 2211/20576* (2013.01);

(Continued)

(58) Field of Classification Search
USPC ..... 60/422, 426, 420
See application file for complete search history.

(56) References Cited

U.S. PATENT DOCUMENTS 5,029,067 A * 7/1991 Nishida et al. ..... 700/68
5,182,908 A * 2/1993 Devier et al. ..... 60/420
5,305,681 A * 4/1994 Devier et al. ..... 91/361

(Continued)

FOREIGN PATENT DOCUMENTS

JP 05-248404 A 9/1993
JP H06-041764 * 6/1994

(Continued)

OTHER PUBLICATIONS

JP06-041764—Japanese to English machine translation, "full contents".*

(Continued)

*Primary Examiner* — Edward Look
*Assistant Examiner* — Michael Quandt
(74) *Attorney, Agent, or Firm* — Global IP Counselors, LLP

(57) ABSTRACT

In a work machine, a control unit controls a pilot control valve for controlling the opening area of a first direction switch valve in executing the combined operation to be less than or equal to that in executing a single operation. The combined operation represents an operation of simultaneously operating first and second actuators. The single operation represents an operation of operating only the first actuator. Further, the control unit determines the opening area of the first direction switch valve in the combined operation based on a hydraulic pressure detected by a hydraulic pressure detector unit.

7 Claims, 6 Drawing Sheets

(52) U.S. Cl.
CPC ..... *F15B 2211/3116* (2013.01); *F15B 2211/31582* (2013.01); *F15B 2211/329* (2013.01); *F15B 2211/6355* (2013.01)

(56) References Cited

U.S. PATENT DOCUMENTS

| | | | | |
|---|---|---|---|---|
| 5,520,087 | A * | 5/1996 | Takamura et al. | 91/532 |
| 5,737,993 | A * | 4/1998 | Cobo et al. | 91/361 |
| 5,968,104 | A * | 10/1999 | Egawa et al. | 701/50 |
| 6,119,967 | A * | 9/2000 | Nakayama et al. | 241/34 |
| 6,173,573 | B1 * | 1/2001 | Kamada | 60/422 |
| 6,282,891 | B1 * | 9/2001 | Rockwood | 60/422 |
| 6,321,152 | B1 * | 11/2001 | Amborski et al. | 701/50 |
| 6,438,953 | B1 * | 8/2002 | Kamada | 60/422 |
| 6,498,973 | B2 * | 12/2002 | Dix et al. | 701/50 |
| 6,618,659 | B1 * | 9/2003 | Berger et al. | 701/50 |
| 6,938,535 | B2 * | 9/2005 | Price | 91/361 |
| 7,146,808 | B2 * | 12/2006 | Devier et al. | 60/422 |
| 7,260,931 | B2 * | 8/2007 | Egelja et al. | 60/422 |
| 2009/0145120 | A1 * | 6/2009 | Esders et al. | 60/422 |

FOREIGN PATENT DOCUMENTS

| | | | |
|---|---|---|---|
| JP | 2006-97854 | A | 4/2006 |
| JP | 2008-224038 | A | 9/2008 |

OTHER PUBLICATIONS

JPH06-041764—Japanese to English machine translation, "full contents" from JPO. Jun. 1, 1994.*

International Search Report of corresponding PCT Application No. PCT/JP2010/059647, Dec. 16, 2010.

* cited by examiner ps1

| PILOT PRESSURE FROM BOOM OPERATING PART (BOOM ELEVATION ACTION): Ppb | | 0 | 8 | 17 | 26 | 30 | 35 |
|---|---|---|---|---|---|---|---|
| FLOW RATIO TO BOOM CYLINDER (ENTIRE FLOW RATE = 10): r | | 0 | 0 | 3.5 | 7 | 8 | 8 |
| ARM CYLINDER PRESSURE Pca | 0 | 700 | 700 | 51.4 | 23.7 | 15.8 | 15.8 |
| | 50 | 700 | 700 | 62.0 | 28.6 | 19.1 | 19.1 |
| | 75 | 700 | 700 | 70.5 | 32.5 | 21.7 | 21.7 |
| | 100 | 700 | 700 | 83.9 | 38.7 | 25.8 | 25.8 |
| | 140 | 700 | 700 | 700 | 700 | 700 | 700 |
| | 300 | 700 | 700 | 700 | 700 | 700 | 700 |

ps2

FIG. 5

WORK MACHINE AND CONTROL METHOD FOR WORK MACHINES

CROSS-REFERENCE TO RELATED APPLICATIONS

This national phase application claims priority to Japanese Patent Application No. 2009-141436 filed on Jun. 12, 2009. The entire disclosure of Japanese Patent Application No. 2009-141436 is hereby incorporated herein by reference.

TECHNICAL FIELD

The present invention relates to a work machine and a control method for work machines.

BACKGROUND ART

The work machines such as the hydraulic excavators are embedded with a hydraulic circuit that a hydraulic pump is used in common for driving a plurality of actuators. In such work machines, a large amount of the hydraulic fluid flows towards a less loaded actuator in executing a combined operation of simultaneously driving a plurality of actuators. In this case, shortage of the flow rate of the hydraulic fluid is problematic in a more loaded actuator.

To solve the problem, the well-known work machines have been configured to execute a control of reducing the opening size of the control valve for one actuator (hereinafter referred to as "a non-prioritized actuator") in executing the combined operation than that in executing a single operation (see, Japan Laid-open Patent Application Publication No. JP-A-2006-97854). With the control, a sufficient amount of the hydraulic fluid can be supplied to the other actuator (hereinafter referred to as "a prioritized actuator").

SUMMARY

In the well-known work machines, however, the opening size of the control valve for the non-prioritized actuator is reduced only based on an operation of an operating unit for instructing actions of the actuators. Even if a large load is herein applied to the non-prioritized actuator, the opening size of the control valve is reduced when a predetermined operation is executed for the operating unit. Therefore, the action speed of the actuator may be reduced. Further, when a large load is applied to the non-prioritized actuator, the hydraulic fluid easily flows towards the prioritized actuator. Therefore, a sufficient flow rate of the hydraulic fluid can be supplied to the prioritized actuator without reducing the opening size of the control valve for the non-prioritized actuator. Nevertheless, it is unavoidable to reduce the opening size of the control valve for the non-prioritized actuator. This causes loss of the hydraulic pressure.

It is an object of the present invention to provide a work machine and a control method thereof for inhibiting slowdown of the action speed of an actuator and occurrence of hydraulic pressure loss in executing a combined operation.

A work machine according to a first aspect of the present invention includes a hydraulic pump configured to discharge a hydraulic fluid, a first actuator, a first direction switch valve, a second actuator, a second direction switch valve, an operating unit, a first hydraulic pressure detector unit, a pilot pressure control valve and the control unit. The first actuator is configured to be driven by the hydraulic fluid discharged from the hydraulic pump. The first direction switch valve is configured to switch between directions of supplying the hydraulic fluid from the hydraulic pump. The first direction switch valve is configured to change an opening area of a flow path of the hydraulic fluid for changing a flow rate of the hydraulic fluid to be supplied to the first actuator. The second actuator is configured to be driven by the hydraulic fluid discharged from the hydraulic pump. The second direction switch valve is configured to switch between directions of supplying the hydraulic fluid from the hydraulic pump. The second direction switch valve is configured to change an opening area of a flow path of the hydraulic fluid for changing a flow rate of the hydraulic fluid to be supplied to the second actuator. The operating unit is configured to operate the first actuator and the second actuator. The first hydraulic pressure detector unit is configured to detect a hydraulic pressure to be supplied to the first actuator. The pilot pressure control valve is configured to regulate a pilot pressure to be inputted into a pilot port of the first direction switch valve to adjust the opening area of the first direction switch valve. The control unit is configured to control the pilot pressure control valve to control the opening area of the first direction switch valve in executing a combined operation to be less than or equal to the opening area of the first direction switch valve in executing a single operation. The combined operation herein represents an operation of simultaneously operating the first and second actuators. The single operation herein represents an operation of operating only the first actuator of the first and second actuators. Further, the control unit is configured to determine the opening area of the first direction switch valve in executing the combined operation based on the hydraulic pressure detected by the first hydraulic pressure detector unit.

A work machine according to a second aspect of the present invention relates to the work machine according to the first aspect of the present invention. In the work machine, the control unit is configured to increase the opening area of the first direction switch valve in proportion to increase in the hydraulic pressure detected by the first hydraulic pressure detector unit in order to control the opening area of the first direction switch valve in executing the combined operation to be less than the opening area of the first direction switch valve in executing the single operation.

A work machine according to a third aspect of the present invention relates to the work machine according to the second aspect of the present invention. In the work machine, the operating unit includes a first operating part and a second operating part. The first operating part is configured to operate the first actuator, while the second operating part is configured to operate the second actuator. The control unit is configured to determine a flow rate of the hydraulic fluid to be supplied to the first actuator and a flow rate of the hydraulic fluid to be supplied to the second actuator in accordance with an operating amount of the first operating part and an operating amount of the second operating part in executing the combined operation. Further, the control unit is configured to determine the opening area of the first direction switch valve based on the flow rate of the hydraulic fluid to be supplied to the first actuator, the hydraulic pressure detected by the first hydraulic pressure detector unit and the hydraulic pressure to be supplied to the second actuator.

A work machine according to a fourth aspect of the present invention relates to the work machine according to the third aspect of the present invention. In the work machine, the control unit is configured to use a fixed value preliminarily stored as a hydraulic pressure to be supplied to the second actuator in executing the combined operation.

A work machine according to a fifth aspect of the present invention relates to the work machine according to one of the first to fourth aspects of the present invention. The work machine further includes a vehicle body, a boom attached to the vehicle body, an arm attached to the boom and a working attachment attached to the arm. In the work machine, the first actuator is configured to drive the arm. Further, the second actuator is configured to drive the boom.

A work machine according to a sixth aspect of the present invention relates to the work machine according to one of the first to fourth aspects of the present invention. The work machine further includes a vehicle body, a boom attached to the vehicle body, an arm attached to the boom and a working attachment attached to the arm. The vehicle body includes a traveling unit and a revolving unit disposed on the traveling unit. In the work machine, the first actuator is configured to drive the boom. Further, the second actuator is configured to revolve the revolving unit.

A method of controlling a work machine according to a seventh aspect of the present invention is a method of controlling a work machine including a hydraulic pump configured to discharge a hydraulic fluid, a first actuator, a first direction switch valve, a second actuator, a second direction switch valve, an operating unit, a first hydraulic pressure detector unit and a pilot pressure control valve. The first actuator is configured to be driven by the hydraulic fluid discharged from the hydraulic pump. The first direction switch valve is configured to switch between directions of supplying the hydraulic fluid from the hydraulic pump. Further, the first direction switch valve is configured to change an opening area of a flow path of the hydraulic fluid for changing a flow rate of the hydraulic fluid to be supplied to the first actuator. The second actuator is configured to be driven by the hydraulic fluid discharged from the hydraulic pump. The second direction switch valve is configured to switch between directions of supplying the hydraulic fluid from the hydraulic pump. Further, the second direction switch valve is configured to change an opening area of a flow path of the hydraulic fluid for changing a flow rate of the hydraulic fluid to be supplied to the second actuator. The operating unit is configured to operate the first actuator and the second actuator. The first hydraulic pressure detector unit is configured to detect a hydraulic pressure to be supplied to the first actuator. The pilot pressure control valve is configured to regulate a pilot pressure to be inputted into a pilot port of the first direction switch valve. The method includes the steps controlling the pilot pressure control valve to control the opening area of the first direction switch valve in executing a combined operation to be less than or equal to the opening area of the first direction switch valve in executing a single operation, determining the opening area of the first direction switch valve in executing the combined operation based on the hydraulic pressure detected by the first hydraulic pressure detector unit. The combined operation herein represents an operation of simultaneously operating the first and second actuators. The single operation herein represents an operation of operating only the first actuator of the first and second actuators.

According to the work machine of the first aspect of the present invention, the opening area of the first direction switch valve in executing the combined operation is controlled to be less than or equal to that in executing the single operation. The magnitude of the opening area is herein determined based on the hydraulic pressure detected by the first hydraulic pressure detector unit. Therefore, it is possible to determine the opening area of the first direction switch valve in accordance with an actual load of the first actuator. It is thereby possible to inhibit the opening area of the first direction switch valve from being unnecessarily constricted. As a result, it is possible to inhibit slowdown of the action speed of the actuator in executing the combined operation and occurrence of hydraulic pressure loss.

According to the work machine of the second aspect of the present invention, when the opening area of the first direction switch valve is constricted in executing the combined operation, the magnitude of the opening area is regulated in accordance with the load acting on the first actuator. Therefore, it is possible to control the first direction switch valve in response to actual work conditions as appropriate as possible.

According to the work machine of the third aspect of the present invention, the flow rates of the hydraulic fluid to be distributed to the first actuator and the second actuator are determined in accordance with the operating amounts of the first operating part and the second operating part. Further, the opening area of the first direction switch valve is determined based on the determined flow rate of the hydraulic fluid to be supplied to the first actuator, the hydraulic pressure detected by the first hydraulic pressure detector unit and the hydraulic pressure to be supplied to the second actuator. In other words, the opening area of the first direction switch valve, required for supplying the determined flow rate of the hydraulic fluid to the first actuator, is determined in view of the load acting on the first actuator. Accordingly, it is possible to approximate the flow rate of the hydraulic fluid to be actually supplied to the first actuator to the determined flow rate.

According to the work machine of the fourth aspect of the present invention, the preliminarily stored fixed value is used as the hydraulic pressure to be supplied to the second actuator. With the configuration, it is not required to provide a hydraulic pressure detector unit for detecting the hydraulic pressure to be supplied to the second actuator. It is thereby possible to reduce the number of the hydraulic pressure detector units. Further, hunting may occur in the first actuator if the opening area of the first direction switch valve is determined based on the hydraulic pressure to be supplied to the first actuator and the hydraulic pressure to be supplied to the second actuator in such a case that the hydraulic pressure to be supplied to the first actuator and the hydraulic pressure to be supplied to the second actuator both vary. However, occurrence of such hunting can be herein inhibited by using the fixed value as the hydraulic pressure to be supplied to the second actuator.

According to the work machine of the fifth aspect of the present invention, the opening area of the first direction switch valve in executing the combined operation of operating the arm and the boom is controlled to be less than or equal to that in executing the single operation of operating the arm. The magnitude of the opening area of the first direction switch valve is herein determined in accordance with the load acting on the arm. In executing such works as excavation, variation in load acting on the arm is greater than that acting on the boom. Therefore, it is possible to appropriately control the opening area of the first direction switch valve in view of the hydraulic pressure of the first actuator for driving the arm.

According to the work machine of the sixth aspect of the present invention, the opening area of the first direction switch valve in executing the combined operation of driving the boom and revolving the revolving unit is controlled to be less than or equal to that in executing the single operation of operating the boom. The magnitude of the opening area of the first direction switch valve is herein determined in accordance with the load acting on the boom. Variation in load acting on the boom in executing a work with the boom is greater than that acting on the revolving unit in revolving the revolving unit. Therefore, it is possible to appropriately control the opening area of the first direction switch valve in view of the hydraulic pressure of the first actuator for driving the boom.

According to the method of controlling a work machine of the seventh aspect of the present invention, the opening area of the first direction switch valve in executing the combined operation is controlled to be less than or equal to that in executing the single operation. The magnitude of the opening area is herein determined based on the hydraulic pressure detected by the first hydraulic pressure detector unit. Therefore, it is possible to determine the opening area of the first direction switch valve in accordance with actual load acting on the first actuator. In other words, it is possible to inhibit the opening area of the first direction switch valve from being unnecessarily constricted. It is consequently possible to inhibit slowdown of the action speed of the actuator in executing the combined operation and occurrence of hydraulic pressure loss.

BRIEF DESCRIPTION OF THE DRAWINGS

FIG. 5 is a flow ratio table stored in a controller embedded in the hydraulic excavator.

DESCRIPTION OF THE EMBODIMENTS

External Structure

Figure 1:
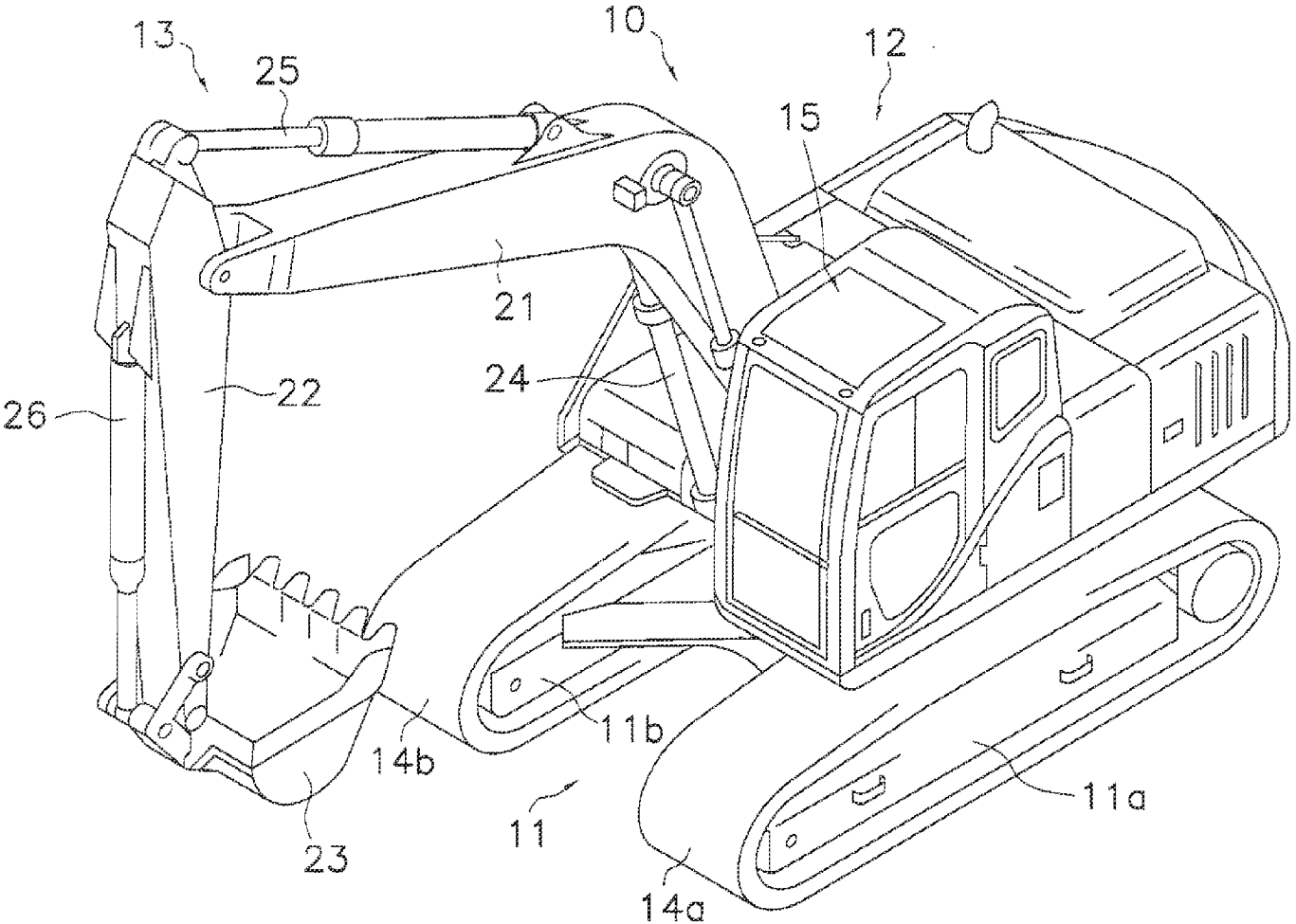
FIG. 1 is an external view of a hydraulic excavator according to an exemplary embodiment of the present invention.

FIG. 1 illustrates a hydraulic excavator 10 (one example of a work machine) according to an exemplary embodiment of the present invention. The hydraulic excavator 10 includes a travelling unit 11, a revolving unit 12 (one example of a vehicle body) and a working unit 13.

The travelling unit 11 includes a pair of drive units 11*a* and 11*b*. The drive unit 11*a* includes a track (crawler belt) 14*a* and a traveling motor (not illustrated in the figures). Likewise, the drive unit 11*b* includes a track 14*b* and a traveling motor (not illustrated in the figures). The traveling motors are configured to drive the tracks 14*a* and 14*b* for causing the hydraulic excavator 10 to travel.

The revolving unit 12 is mounted on the travelling unit 11. The revolving unit 12 is configured to revolve on the travelling unit 11 by means of a revolving motor 27 (see FIG. 2). Further, a cab 15 occupies the front left part of the revolving unit 12.

The working unit 13 is attached to the front center part of the revolving unit 12, and includes a boom 21, an arm 22 and a bucket 23 (one example of a working attachment). The base portion of the boom 21 is rotatably coupled to the revolving unit 12. On the other hand, the tip portion of the boom 21 is rotatably coupled to the base portion of the arm 22. The tip portion of the arm 22 is rotatably coupled to the bucket 23. Further, hydraulic cylinders (i.e., a boom cylinder 24, an arm cylinder 25 and a bucket cylinder 26) are respectively disposed to be paired with the boom 21, the arm 22 and the bucket 23. The working unit 13 is configured to be driven in conjunction with driving of the hydraulic cylinders 24 to 26. Accordingly, the hydraulic excavator 10 executes a variety of works such as excavation.

Hydraulic System Structure

Figure 2:
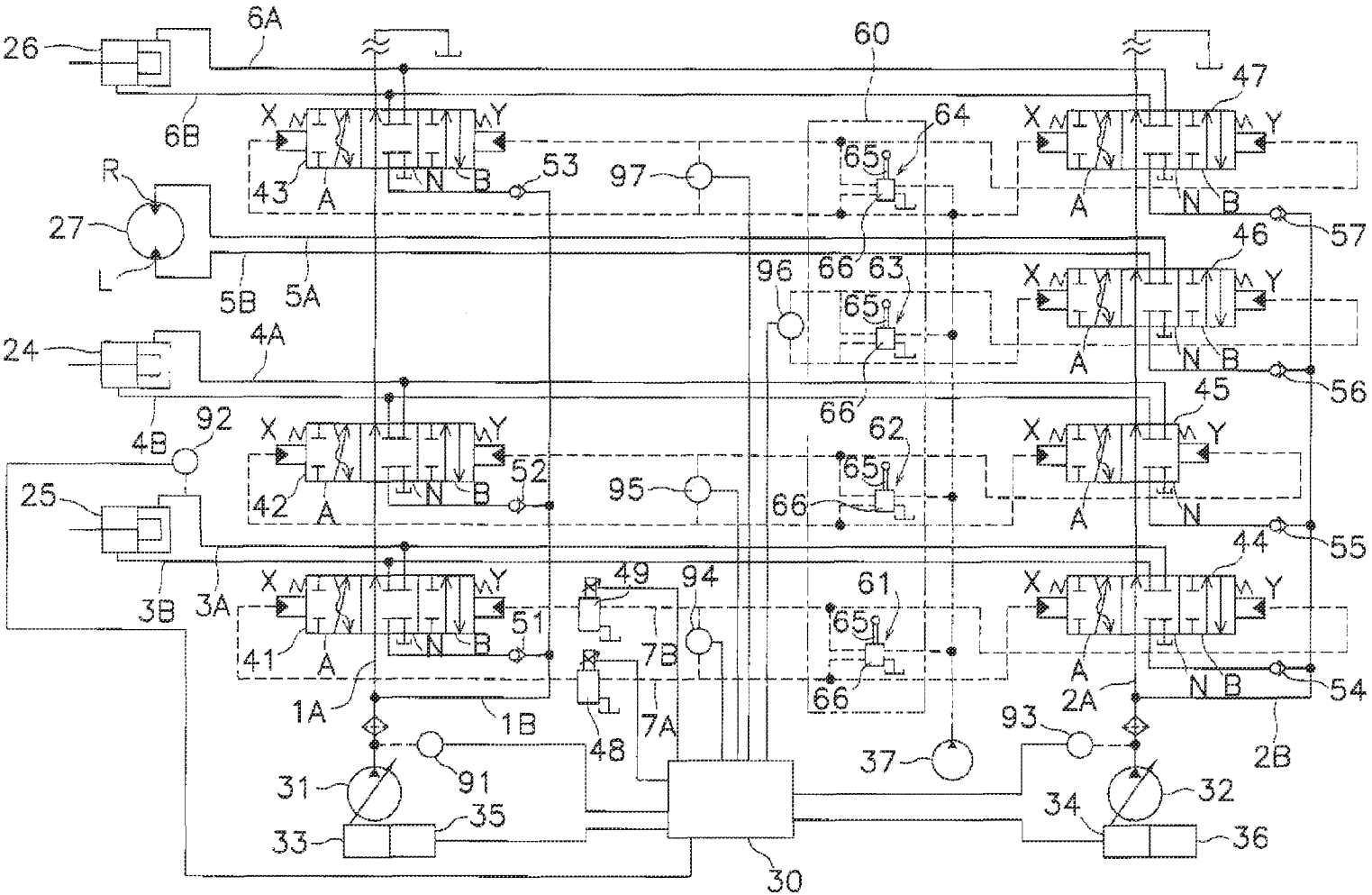
FIG. 2 is a schematic structure of a hydraulic circuit embedded in the hydraulic excavator.

Next, FIG. 2 represents the structure of a hydraulic system embedded in the hydraulic excavator 10. Especially, the hydraulic system structure represents the structure for driving the boom cylinder 24, the arm cylinder 25, the bucket cylinder 26 and the revolving motor 27. A first hydraulic pump 31 and a second hydraulic pump 32 function as driving sources for driving the boom cylinder 24, the arm cylinder 25, the bucket cylinder 26 and the revolving motor 27. The first and second hydraulic pumps 31 and 32 are configured to be driven by an engine (not illustrated in the figures).

Figure 3:
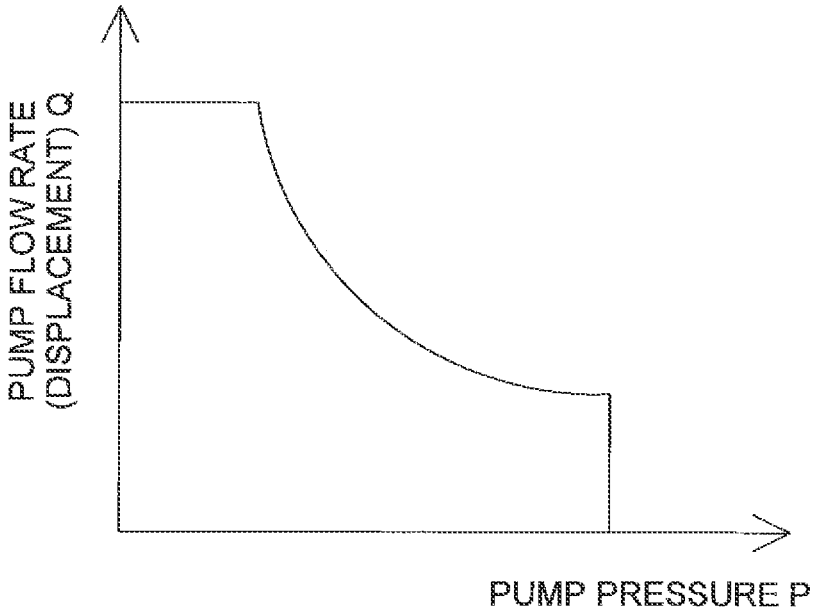
FIG. 3 is a chart representing a PQ characteristic of a hydraulic pump.

Each of the first and second hydraulic pumps 31 and 32 is of a variable displacement type configured to change the tilt angle of a swash plate thereof for changing the discharge amount of the hydraulic fluid. The hydraulic pump 31 is provided with a variable displacement valve 33 for changing the tilt angle of the swash plate thereof Likewise, the hydraulic pump 32 is provided with a variable displacement valve 34 for changing the tilt angle of the swash plate thereof Each of the variable displacement valves 33 and 34 is configured to change the tilt angle of the swash plate in accordance with a pilot pressure to be applied thereto. A pump control valve 35 is configured to control a pilot pressure to be applied to the variable displacement valve 33. Likewise, a pump control valve 36 is configured to control a pilot pressure to be applied to the variable displacement valve 34. Each of the pump control valve 35 and 36 is of an electromagnetic proportion type. The pump control valve 35 is configured to control the pilot pressure to be outputted to the variable displacement valve 33 based on a command signal from the control unit 30. Likewise, the pump control valve 36 is configured to control the pilot pressure to be outputted to the variable displacement valve 34 based on a command signal from the control unit 30. The control unit 30 is configured to control the pump control valves 35 and 36 for causing pump displacement (flow rate) to vary in accordance with pump pressure as represented in a PQ characteristic of FIG. 3. Specifically, the control unit 30 is configured to control pump displacement in accordance with pump pressure for making pump absorption horsepower (P×Q) constant.

The hydraulic fluid, discharged from the first hydraulic pump 31, is supplied via operating valves 41 to 43 to the hydraulic actuators such as the arm cylinder 25, the boom cylinder 24, the bucket cylinder 26 and a left traveling motor (not illustrated in the figures). On the other hand, the hydraulic fluid, discharged from the second hydraulic pump 32, is supplied via operating valves 44 to 47 to the hydraulic actuators such as the arm cylinder 25, the boom cylinder 24, the revolving motor 27, the bucket cylinder 26 and a right traveling motor (not illustrated in the figures). Further, the hydraulic fluid supplied to the hydraulic actuators is recovered by a tank via the operating valves 41 to 47.

Specifically, the operating valves 41 to 47 include a first arm operating valve 41 (one example of a first direction switch valve), a first boom operating valve 42 (one example of a second direction switch valve), a first bucket operating valve 43, a second arm operating valve 44, a second boom operating valve 45, a revolving motor operating valve 46 and a second bucket operating valve 47.

A flow path 1A is connected to the first hydraulic pump 31. The first arm operating valve 41, the first boom operating valve 42 and the first bucket operating valve 43 are provided in the flow path 1A. A flow path 1B is branched from the flow path 1A. The first arm operating valve 41 is connected to the flow path 1B through a check valve 51. The first boom operating valve 42 is connected to the flow path 1B through a check valve 52. The first bucket operating valve 43 is connected to the flow path 1B through a check valve 53. Thus, the first arm operating valve 41, the first boom operating valve 42 and the first bucket operating valve 43 are connected to the flow path 1B in parallel to each other. A hydraulic pressure sensor 91 is connected to the flow path 1A. The hydraulic pressure sensor 91 is configured to detect the pressure of the hydraulic fluid discharged from the first hydraulic pump 31 (hereinafter referred to as "a first pump pressure"). The hydraulic pressure sensor 91 is configured to transmit to the control unit 30 a detection signal corresponding to the detected first pump pressure.

Further, a flow path 3A is connected to a bottom side oil chamber of the arm cylinder 25. A hydraulic pressure sensor 92 (one example of a first hydraulic pressure detector unit) is connected to the flow path 3A. The hydraulic pressure sensor 92 is configured to detect the pressure of the hydraulic fluid to be supplied to the bottom side oil chamber of the arm cylinder 25 (hereinafter referred to as "an arm cylinder pressure"). The hydraulic pressure sensor 92 is configured to transmit to the control unit 30 a detection signal corresponding to the detected arm cylinder pressure. On the other hand, a flow path 3B is connected to a head side oil chamber of the arm cylinder 25. Further, a flow path 4A is connected to a bottom side oil chamber of the boom cylinder 24. On the other hand, a flow path 4B is connected to a head side oil chamber of the boom cylinder 24. Further, a flow path 5A is connected to a right revolving port R of the revolving motor 27. On the other hand, a flow path 5B is connected to a left revolving port L of the revolving motor 27. Yet further, a flow path 6B is connected to a head side oil chamber of the bucket cylinder 26. On the other hand, a flow path 6A is connected to a bottom side oil chamber of the bucket cylinder 26.

Each of the first arm operating valve 41, the first boom operating valve 42 and the first bucket operating valve 43 is a direction switching valve configured to switch the supply direction of the hydraulic fluid from the first hydraulic pump 31. Each of the first arm operating valve 41, the first boom operating valve 42 and the first bucket operating valve 43 is configured to be switched among states A, N and B in accordance with the pilot pressure to be supplied to its pilot ports X and Y. Further, each of the first arm operating valve 41, the first boom operating valve 42 and the first bucket operating valve 43 is configured to change the opening area of the flow path of the hydraulic fluid in accordance with the pilot pressure applied thereto in order to change the flow rate of the hydraulic fluid to be supplied to the hydraulic actuator connected thereto.

The first arm operating valve 41 is configured to control the supply of the hydraulic fluid from the first hydraulic pump 31 to the aim cylinder 25. In the state A, the first aim operating valve 41 is configured to cause the hydraulic fluid to flow between the flow path 1B and the flow path 3A, and simultaneously, between the flow path 3B and the tank. The hydraulic fluid is thereby supplied from the first hydraulic pump 31 to the bottom side oil chamber of the arm cylinder 25, while the hydraulic fluid is discharged from the head side oil chamber of the arm cylinder 25. Consequently, the arm cylinder 25 is extended. In the state B, the first arm operating valve 41 is configured to cause the hydraulic fluid to flow between the flow path 1B and the flow path 3B, and simultaneously, between the flow path 3A and the tank. The hydraulic fluid is thereby supplied from the first hydraulic pump 31 to the head side oil chamber of the arm cylinder 25, while the hydraulic fluid is discharged from the bottom side oil chamber of the aim cylinder 25. Consequently, the arm cylinder 25 is contracted. In the state N, the first arm operating valve 41 is configured to cause the hydraulic fluid to flow between the first hydraulic pump 31 side and the first boom operating valve 42 side in the flow path 1A. Simultaneously, the first arm operating valve 41 is configured to block the hydraulic fluid from flowing between the arm cylinder 25 and the first hydraulic pump 31 and between the aim cylinder 25 and the tank.

The first boom operating valve 42 is configured to control the supply of the hydraulic fluid from the first hydraulic pump 31 to the boom cylinder 24. In the state A, the first boom operating valve 42 is configured to cause the hydraulic fluid to flow between the flow path 1B and the flow path 4A, and simultaneously, between the flow path 4B and the tank. The hydraulic fluid is thereby supplied from the first hydraulic pump 31 to the bottom side oil chamber of the boom cylinder 24, while the hydraulic fluid is discharged from the head side oil chamber of the boom cylinder 24. Consequently, the boom cylinder 24 is extended. In the state B, the first boom operating valve 42 is configured to cause the hydraulic fluid to flow between the flow path 1B and the flow path 4B, and simultaneously, between the flow path 4A and the tank. The hydraulic fluid is thereby supplied from the first hydraulic pump 31 to the head side oil chamber of the boom cylinder 24, while the hydraulic fluid is discharged from the bottom side oil chamber of the boom cylinder 24. Consequently, the boom cylinder 24 is contracted. In the state N, the first boom operating valve 42 is configured to cause the hydraulic fluid to flow between the first arm operating valve 41 side and the first bucket operating valve 43 side in the flow path 1A. Simultaneously, the first boom operating valve 42 is configured to block the hydraulic fluid from flowing between the boom cylinder 24 and the first hydraulic pump 31 and between the boom cylinder 24 and the tank.

The first bucket operating valve 43 is configured to control the supply of the hydraulic fluid from the first hydraulic pump 31 to the bucket cylinder 26. In the state A, the first bucket operating valve 43 is configured to cause the hydraulic fluid to flow between the flow path 1B and the flow path 6A, and simultaneously, between the flow path 6B and the tank. The hydraulic fluid is thereby supplied from the first hydraulic pump 31 to the bottom side oil chamber of the bucket cylinder 26, while the hydraulic fluid is discharged from the head side oil chamber of the bucket cylinder 26. Consequently, the bucket cylinder 26 is extended. In the state B, the first bucket operating valve 43 is configured to cause the hydraulic fluid to flow between the flow path 1B and the flow path 6B, and simultaneously, between the flow path 6A and the tank. The hydraulic fluid is thereby supplied from the first hydraulic pump 31 to the head side oil chamber of the bucket cylinder 26, while the hydraulic fluid is discharged from the bottom side oil chamber of the bucket cylinder 26. Consequently, the bucket cylinder 26 is contracted. In the state N, the first bucket operating valve 43 is configured to cause the hydraulic fluid to flow between the first boom operating valve 42 side and the tank side in the flow path 1A. Simultaneously, the first bucket operating valve 43 is configured to block the hydraulic fluid from flowing between the bucket cylinder 26 and the first hydraulic pump 31 and between the bucket cylinder 26 and the tank.

Further, a flow path 2A is connected to the second hydraulic pump 32. The second arm operating valve 44, the second boom operating valve 45, the revolving motor operating valve 46 and the second bucket operating valve 47 are provided in the flow path 2A. A flow path 2B is branched form the flow path 2A. The second arm operating valve 44 is connected to the flow path 2B through a check valve 54. The second boom operating valve 45 is connected to the flow path 2B through a check valve 55. The revolving motor operating valve 46 is connected to the flow path 2B through a check valve 56. The second bucket operating valve 47 is connected to the flow path 2B through a check valve 57. Thus, the second arm operating valve 44, the second boom operating valve 45, the revolving motor operating valve 46 and the second bucket operating valve 47 are connected to the flow path 2B in parallel to each other. A hydraulic pressure sensor 93 is connected to the flow path 2A. The hydraulic pressure sensor 93 is configured to detect the pressure of the hydraulic fluid discharged from the second hydraulic pump 32 (hereinafter refereed to as "a second pump pressure"). The hydraulic pressure sensor 93 is configured to transmit to the control unit 30 a detection signal corresponding to the detected second pump pressure to the control unit 30.

Each of the second arm operating valve 44, the second boom operating valve 45, the revolving motor operating valve 46 and the second bucket operating valve 47 is a direction switching valve configured to switch the supply direction of the hydraulic fluid from the second hydraulic pump 32. Each of the second arm operating valve 44, the revolving motor operating valve 46 and the second bucket operating valve 47 is configured to be switched among states A, N and B in accordance with the pilot pressure to be supplied to its pilot ports X and Y. By contrast, the second boom operating valve 45 is configured to be switched between the state A and the state N in accordance with the pilot pressure to be supplied to its pilot ports X and Y. Further, each of the second arm operating valve 44, the second boom operating valve 45, the revolving motor operating valve 46 and the second bucket operating valve 47 is configured to change the opening area of the flow path of the hydraulic fluid in accordance with the pilot pressure applied thereto in order to change the flow rate of the hydraulic fluid to be supplied to the hydraulic actuator connected thereto.

The second arm operating valve 44 is configured to control the supply of the hydraulic fluid from the second hydraulic pump 32 to the arm cylinder 25. In the state A, the second arm operating valve 44 is configured to cause the hydraulic fluid to flow between the flow path 2B and the flow path 3A, and simultaneously, between the flow path 3B and the tank. The hydraulic fluid is thereby supplied from the second hydraulic pump 32 to the bottom side oil chamber of the arm cylinder 25, while the hydraulic fluid is discharged from the head side oil chamber of the arm cylinder 25. Consequently, the arm cylinder 25 is extended. In the state B, the second arm operating valve 44 is configured to cause the hydraulic fluid to flow between the flow path 2B and the flow path 3B, and simultaneously, between the flow path 3A and the tank. The hydraulic fluid is thereby supplied from the second hydraulic pump 32 to the head side oil chamber of the arm cylinder 25, while the hydraulic fluid is discharged from the bottom side oil chamber of the arm cylinder 25. Consequently, the arm cylinder 25 is contracted. In the state N, the second arm operating valve 44 is configured to cause the hydraulic fluid to flow between the second hydraulic pump 32 side and the second boom operating valve 45 side in the flow path 2A. Simultaneously, the second arm operating valve 44 is configured to block the hydraulic fluid from flowing between the arm cylinder 25 and the second hydraulic pump 32 and between the arm cylinder 25 and the tank.

The second boom operating valve 45 is configured to control the supply of the hydraulic fluid from the second hydraulic pump 32 to the boom cylinder 24. In the state A, the second boom operating valve 45 is configured to cause the hydraulic fluid to flow between the flow path 2B and the flow path 4A, and simultaneously, between the flow path 4B and the tank. The hydraulic fluid is thereby supplied from the second hydraulic pump 32 to the bottom side oil chamber of the boom cylinder 24, while the hydraulic fluid is discharged from the head side oil chamber of the boom cylinder 24. Consequently, the boom cylinder 24 is extended. In the state N, the second boom operating valve 45 is configured to cause the hydraulic fluid to flow between the second arm operating valve 44 side and the revolving motor operating valve 46 side in the flow path 2A. Simultaneously, the second boom operating valve 45 is configured to block the hydraulic fluid from flowing between the boom cylinder 24 and the second hydraulic pump 32 and between the boom cylinder 24 and the tank.

The revolving motor operating valve 46 is configured to control the supply of the hydraulic fluid from the second hydraulic pump 32 to the revolving motor 27. In the state A, the revolving motor operating valve 46 is configured to cause the hydraulic fluid to flow between the flow path 2B and the flow path 5A, and simultaneously, between the flow path 5B and the tank. The hydraulic fluid is thereby supplied from the second hydraulic pump 32 to the right revolving port R of the revolving motor 27, while the hydraulic fluid is discharged from the left revolving port L of the revolving motor 27. Consequently, the revolving motor 27 is configured to rotate in a direction corresponding to rightward revolving of the revolving unit 12. In the state B, the revolving motor operating valve 46 is configured to cause the hydraulic fluid to flow between the flow path 2B and the flow path 5B, and simultaneously, between the flow path 5A and the tank. The hydraulic fluid is thereby supplied from the second hydraulic pump 32 to the left revolving port L of the revolving motor 27, while the hydraulic fluid is discharged from the right revolving port R of the revolving motor 27. Consequently, the revolving motor 27 is configured to rotate in a direction corresponding to leftward revolving of the revolving unit 12. In the state N, the revolving motor operating valve 46 is configured to cause the hydraulic fluid to flow between the second boom operating valve 45 side and the second bucket operating valve 47 side in the flow path 2A. Further, the revolving motor operating valve 46 is configured to block the hydraulic fluid from flowing between the revolving motor 27 and the second hydraulic pump 32 and between the revolving motor 27 and the tank.

The second bucket operating valve 47 is configured to control the supply of the hydraulic fluid from the second hydraulic pump 32 to the bucket cylinder 26. In the state A, the second bucket operating valve 47 is configured to cause the hydraulic fluid to flow between the flow path 2B and the flow path 6A, and simultaneously, between the flow path 6B and the tank. The hydraulic fluid is thereby supplied from the second hydraulic pump 32 to the bottom side oil chamber of the bucket cylinder 26, while the hydraulic fluid is discharged from the head side oil chamber of the bucket cylinder 26. Consequently, the bucket cylinder 26 is extended. In the state B, the second bucket operating valve 47 is configured to cause the hydraulic fluid to flow between the flow path 2B and the flow path 6B, and simultaneously, between the flow path 6A and the tank. The hydraulic fluid is thereby supplied from the second hydraulic pump 32 to the head side oil chamber of the bucket cylinder 26, while the hydraulic fluid is discharged from the bottom side oil chamber of the bucket cylinder 26. Consequently, the bucket cylinder 26 is contracted. In the state N, the second bucket operating valve 47 is configured to cause the hydraulic fluid to flow between the revolving motor operating valve 46 side and the tank side in the flow path 2A. Simultaneously, the second bucket operating valve 47 is configured to block the hydraulic fluid from flowing between the bucket cylinder 26 and the second hydraulic pump 32 and between the bucket cylinder 26 and the tank.

Each of the aforementioned operating valves 41 to 47 includes a pair of the pilot ports X and Y, and is configured to be controlled in response to the hydraulic fluid of a predetermined pilot pressure supplied to each of the pilot ports X and Y. The pilot pressure to be applied to each of the operating valves 41 to 47 is controlled in response to an operation of an operating unit 60. In other words, actions of the working unit 13 and revolving actions of the revolving unit 12 are controlled in response to an operation of the operating unit 60.

The operating unit 60 is a device for operating the arm cylinder 25, the boom cylinder 24, the revolving motor 27 and the bucket cylinder 26. The operating unit 60 includes an arm operating part 61 (one example of a first operating part), a boom operating part 62 (one example of a second operating part), a revolving operating part 63 and a bucket operating part 64. Each of the arm operating part 61, the boom operating part 62, the revolving operating part 63 and the bucket operating part 64 includes an operating lever 65 and a pilot valve 66. The operating levers 65 are operating members disposed within the cab 15 and are operated by an operator. Each of the pilot valves 66 is configured to regulate the pressure of the hydraulic fluid discharged from a pilot hydraulic pump 37 in accordance with the operating amount of the corresponding operating lever 65 and output the hydraulic fluid of the regulated pressure.

The pilot pressure, outputted from the pilot valve 66 of the arm operating part 61, is applied to the pilot ports X and Y of the first arm operating valve 41 and those of the second arm operating valve 44. A hydraulic pressure sensor 94 is configured to detect the pilot pressure outputted from the arm operating part 61. The pilot pressure, outputted from the pilot valve 66 of the boom operating part 62, is applied to the pilot ports X and Y of the first boom operating valve 42 and those of the second boom operating valve 45. A hydraulic pressure sensor 95 is configured to detect the pilot pressure outputted from the boom operating part 62. The pilot pressure, outputted from the pilot valve 66 of the revolving operating part 63, is applied to the pilot ports X and Y of the revolving motor operating valve 46. A hydraulic pressure sensor 96 is configured to detect the pilot pressure outputted from the revolving operating part 63. The pilot pressure, outputted from the pilot valve 66 of the bucket operating part 64, is applied to the pilot ports X and Y of the first bucket operating valve 43 and those of the second bucket operating valve 47. A hydraulic pressure sensor 97 is configured to detect the pilot pressure outputted from the bucket operating part 64. Each of the hydraulic pressure sensors 94 to 97 is configured to transmit to the control unit 30 a detection signal corresponding to the pilot pressure detected thereby.

Further, a first pilot control valve 48 (one example of a pilot pressure control valve) is provided in a pilot flow path 7A connecting the arm operating part 61 and the pilot port X of the first arm operating valve 41, while a second pilot control valve 49 (another example of a pilot pressure control valve) is provided in a pilot flow path 7B connecting the arm operating part 61 and the pilot port Y of the first arm operating valve 41. The first pilot control valve 48 is an electromagnetic proportional control valve configured to regulate the pilot pressure to be inputted into the first pilot port X of the first aim operating valve 41 in accordance with a command signal from the control unit 30. The second pilot control valve 49 is an electromagnetic proportional control valve configured to regulate the pilot pressure to be inputted into the second pilot port Y of the first arm operating valve 41 in accordance with a command signal from the control unit 30. Therefore, the control unit 30 can electrically control the opening area of the first arm operating valve 41 by controlling the first and second pilot control valves 48 and 49.

Operations of Hydraulic Actuators

Operations of the hydraulic actuators by the operating unit 60 will be hereinafter explained. First, an exemplary case will be explained that a single operation is executed for operating only one of the plural actuators.

When the operating lever 65 of the arm operating part 61 is tilted in one direction, the pilot valve 66 is configured to cause the hydraulic fluid to flow between the first pilot ports X of the first and second arm operating valves 41 and 44 and the pilot hydraulic pump 37, and simultaneously, between the second pilot ports Y of the first and second arm operating valves 41 and 44 and the tank. The pilot pressure in accordance with the operating amount of the operating lever 65 is thereby applied to the first pilot ports X of the first and second arm operating valves 41 and 44. Subsequently, each of the first and second arm operating valves 41 and 44 is switched into the state A, and the opening area of each of the first and second arm operating valves 41 and 44 is set to be a size in accordance with the pilot pressure applied thereto, i.e., a size in accordance with the operating amount of the operating lever 65. Accordingly, the hydraulic fluid is supplied to the bottom side oil chamber of the arm cylinder 25, and the arm cylinder 25 is extended. Consequently, the hydraulic excavator 10 can execute an excavation work using the working unit 13. The operation for thus extending the arm cylinder 25 will be hereinafter referred to as "an arm excavation operation".

When the operating lever 65 of the arm operating part 61 is tilted to a direction opposite to the aforementioned direction, the pilot valve 66 is configured to cause the hydraulic fluid to flow between the second pilot ports Y of the first and second arm operating valves 41 and 44 and the pilot hydraulic pump 37, and simultaneously, between the first pilot ports X of the first and second aim operating valves 41 and 44 and the tank. The pilot pressure in accordance with the operating amount of the operating lever 65 is thereby applied to the second pilot ports Y of the first and second arm operating valves 41 and 44. Subsequently, each of the first and second arm operating valves 41 and 44 is switched into the state B, and the opening area of each of the first and second arm operating valves 41 and 44 is set to be a size in accordance with the pilot pressure applied thereto, i.e., a size in accordance with the operating amount of the operating lever 65. Accordingly, the hydraulic fluid is supplied to the head side oil chamber of the arm cylinder 25, and the arm cylinder 25 is contracted. Consequently, the hydraulic excavator 10 can execute a dump work using the working unit 13. The operation for thus contracting the arm cylinder 25 will be hereinafter referred to as "an arm dump operation".

The operation of the boom cylinder 24 is basically the same as the aforementioned operation of the arm cylinder 25, excluding that the second boom operating valve 45 is not switched into the state B.

When the operating lever 65 of the boom operating part 62 is tilted in one direction, the boom cylinder 24 is configured to be extended. The operation for thus extending the boom cylinder 24 will be hereinafter referred to as "a boom elevation operation". When the operating lever 65 of the boom operating part 62 is tilted in the other direction, by contrast, the boom cylinder 24 is configured to be contracted. Thus, an operation of lowering the boom can be executed.

The operation of the revolving motor 27 is basically the same as that of the aforementioned aim cylinder 25, excluding that there is no revolving motor operating valve provided with respect to the first hydraulic pump 31. When the operating lever 65 of the revolving operating part 63 is tilted in one direction, the revolving motor operating valve 46 is configured to be switched into the state A. The revolving motor 27 is thereby rotated rightwards for causing the revolving unit 12 to revolve rightwards. When the operating lever 65 of the revolving operating part 63 is tilted in the other direction, by contrast, the revolving motor operating valve 46 is configured to be switched in the state B. The revolving motor 27 is thereby rotated leftwards for causing the revolving unit 12 to revolve leftwards.

The operation of the bucket cylinder 26 is the same as that of the aforementioned aim cylinder 25. When the operating lever 65 of the bucket operating part 64 is tilted in one direction, the bucket cylinder 26 is configured to be extended. Accordingly, the hydraulic excavator 10 can execute an excavating work. When the operating lever 65 of the bucket operating part 64 is tilted in the other direction, by contrast, the bucket cylinder 26 is configured to be contracted. Accordingly, the hydraulic excavator 10 can execute a dump work.

Figure 4:
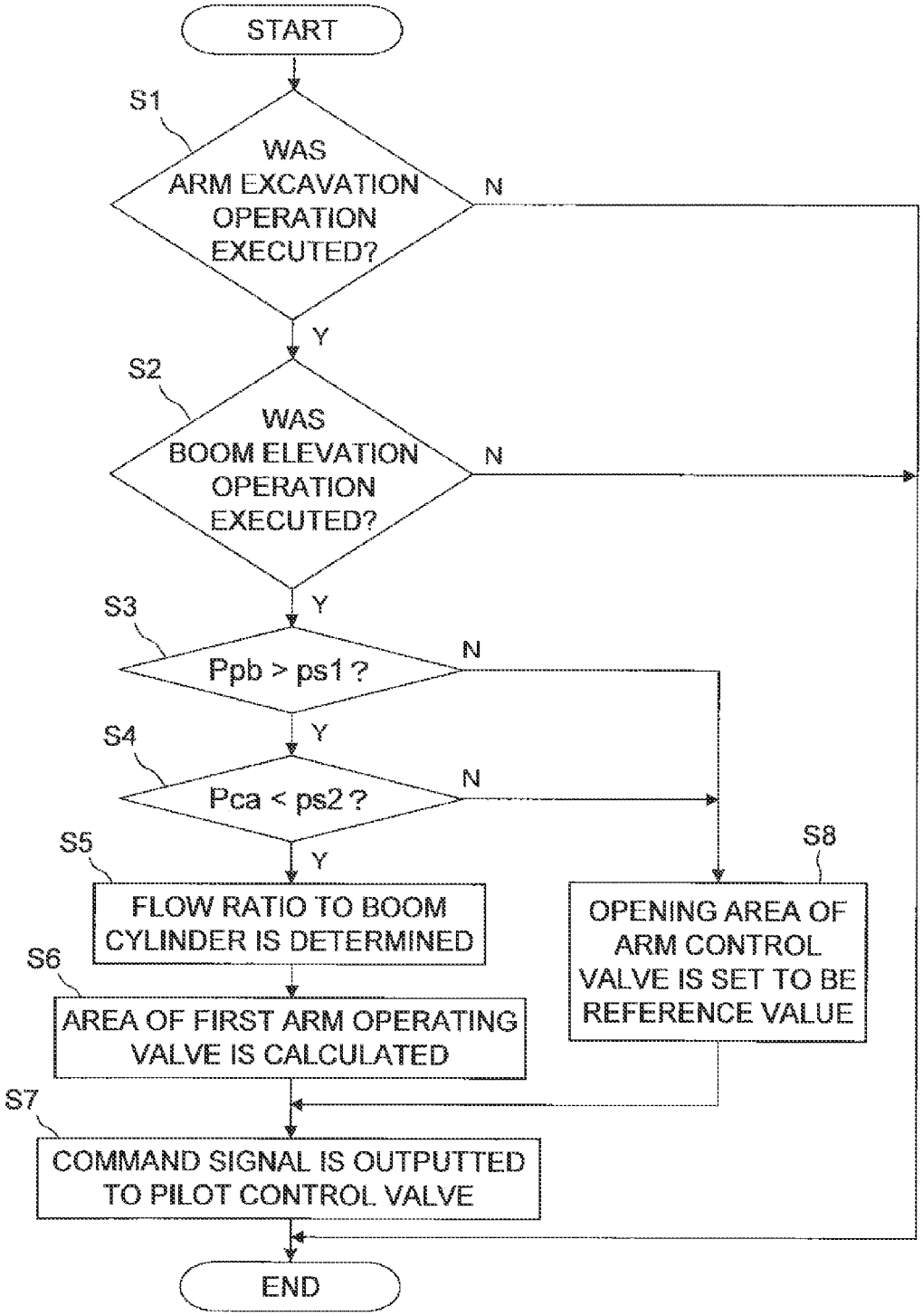
FIG. 4 is a flowchart representing a control to be executed in a combined operation for the hydraulic excavator.

Next, an exemplary case will be hereinafter explained that a combined operation is executed for simultaneously operating a plurality of actuators. Basically, controls are simultaneously executed for a plurality of the aforementioned single operations in executing the combined operation. For example, when the arm operating part 61 and the bucket operating part 64 are simultaneously operated, the arm operating valves 41 and 44 are configured to be controlled in accordance with the operating direction and the operating amount of the arm operating part 61, and simultaneously, the bucket operating valves 43 and 47 are configured to be controlled in accordance with the operating direction and the operating amount of the bucket operating part 64. When predetermined operations of predetermined actuators are combined and simultaneously executed, the control unit 30 is configured to reduce the opening area of the corresponding operating valve for one actuator to be less than that in the single operation (hereinafter referred to as "a reference value") in order to execute a control of causing the hydraulic fluid to easily flow into the other actuator. With reference to a flowchart of FIG. 4, the control in executing the combined operation will be hereinafter explained in detail.

It should be noted that the arm cylinder pressure is detected by the hydraulic pressure sensor 92 and is constantly monitored by the control unit 30 during execution of the following control.

First in Step S1, it is determined whether or not the arm excavation operation is executed. Specifically, it is determined whether or not the arm excavation operation is executed based on the pilot pressure detected by the hydraulic pressure sensor 94. It is herein determined that the arm excavation operation is executed regardless of the state of the second arm operating valve 44 when the pilot pressure detected by the hydraulic pressure sensor 94 is greater than or equal to a value for switching the first arm operating valve 41 into the state A. The processing proceeds to Step S2 when the arm excavation operation is executed.

In Step S2, it is determined whether or not the boom elevation operation is executed. Specifically, it is herein determined whether or not the boom elevation operation is executed based on the pilot pressure from the boom operating part 62 detected by the hydraulic pressure sensor 95. The processing proceeds to Step S3 when the boom elevation operation is executed.

In Step S3, it is determined whether or not a pilot pressure Ppb, which is the pilot pressure from the boom operating part 62 detected by the hydraulic pressure sensor 95, is greater than a predetermined threshold ps1. The threshold ps1 corresponds to a pilot pressure when the boom operating lever 65 is slightly operated. The processing proceeds to Step S4 when the pilot pressure Ppb from the boom operating part 62 is greater than the predetermined threshold ps1.

In Step S4, it is determined whether or not an arm cylinder pressure Pca detected by the hydraulic pressure sensor 92 is less than a predetermined threshold ps2. The threshold ps2 corresponds to an arm cylinder pressure when a large load is applied to the arm cylinder 25. The threshold ps2 is less than a fixed value stored in the control unit 30 as a boom cylinder pressure Pcb to be described. The processing proceeds to Step S5 when the arm cylinder pressure Pca is less than the threshold ps2.

In Step S5, the flow ratio of the hydraulic fluid flowing into the boom cylinder 24 is determined. Specifically, the flow ratio for the boom cylinder 24 is herein determined based on the pilot pressure from the boom operating part 62 detected by the hydraulic pressure sensor 95. The control unit 30 stores a flow ratio table as represented in FIG. 5. The flow ratio table represents values of the pilot pressure Ppb from the boom operating part 62 and values of a flow ratio r for the boom cylinder 24 corresponding to the values of the pilot pressure Ppb. The flow ratio table represents an appropriate flow ratio of the hydraulic fluid flowing into the boom cylinder 24 when the combined operation is executed for executing the arm excavation operation and the boom elevation operation. In FIG. 5, the flow ratio table contains values of the pilot pressure Ppb from the boom operating part 62 in the top line. Further, the flow ratio table contains values of the flow ratio r for the boom cylinder 24 respectively corresponding to values of the pilot pressure Ppb in the second line from top. The flow ratio r represents a ratio of the flow rate of the hydraulic fluid flowing into the boom cylinder 24 where the entire flow rate of the hydraulic fluid of the first hydraulic pump 31 is set to be 10. It should be noted that a value of the flow ratio, corresponding to value of the pilot pressure not contained in the flow ratio table, is obtained by a proportional calculation based on the values contained in the flow ratio table. The control unit 30 is configured to determine the flow ratio for the boom cylinder 24 with reference to the aforementioned flow ratio table.

Next in Step S6, the opening area of the first arm operating valve 41 is calculated. The opening area of the first arm operating valve 41 is herein calculated based on the following equation.

$$A = \frac{Q \times \frac{(10 - r)}{10}}{Ca \times \sqrt{Pcb - Pca}} \qquad \text{Equation 1}$$

In the above equation, "A" is equal to "$A_0$" (i.e., $A=A_0$) where Pca is greater than Pcb (i.e., Pca>Pcb). "A" represents the opening area of the first arm operating valve 41. "Q" represents the entire flow rate of the hydraulic fluid of the first hydraulic pump 31. "r" represents the flow ratio for the boom cylinder 24 determined in Step S5. "Ca" represents a predetermined constant. "Pcb" represents the pressure of the hydraulic fluid to be supplied to the boom cylinder 24 (hereinafter referred to as "a boom cylinder pressure") and a fixed value stored in the control unit 30 is used as "Pcb". "Pca" represents the arm cylinder pressure detected by the hydraulic pressure sensor 92. "$A_0$" represents a value of the opening area of the first arm operating valve 41 when a single operation is executed for the arm cylinder 25. "$A_0$" is a constant value to be determined by the opening shape of the valve spool of the first arm operating valve 41.

Next in Step S7, the control unit 30 is configured to output command signals to the first and second pilot control valves 48 and 49. The first and second pilot control valves 48 and 49 are controlled by the command signals in order to achieve the value calculated in Step S6 for the opening area of the first aim operating valve 41.

It should be noted that the processing proceeds to Step S8 when the pilot pressure Ppb from the boom operating part 62 is less than or equal to the threshold ps1 in Step S3. Further, the processing also proceeds to Step S8 when the arm cylinder pressure Pca is greater than or equal to the threshold ps2 in Step S4.

In Step S8, the opening area of the first arm operating valve 41 is set to be the reference value. As described above, the reference value is the value $A_0$ of the opening area of the first arm operating valve 41 when the single operation is executed for the arm cylinder 25.

It should be noted that "A" may be greater than "$A_0$" ($A>A_0$) in Step S6 when the value of the arm cylinder pressure Pca is close to that of the boom cylinder pressure Pcb. In this case, the opening area of the first arm operating valve 41 is set to be the opening area $A_0$ of the first arm operating valve 41 in executing the single operation.

Next in Step S7, command signals are outputted to the pilot control valves 48 and 49 in order to achieve the value determined in Step S8 for the opening area of the first arm operating valve 41.

FIG. 5 represents exemplary values of the opening area of the first aim operating valve 41 to be determined based on the aforementioned flow. FIG. 5 represents not only the aforementioned flow ratio table but also values of the opening area of the first arm operating valve 41 respectively corresponding to values of the arm cylinder pressure Pca. Specifically, values of the opening area of the first arm operating valve 41 are herein exemplified where the entire flow rate Q of the first hydraulic pump 31 is set to be 500; the boom cylinder pressure Pcb (fixed value) is set to be 160; the constant Ca is set to be 0.5; and a reference value of the opening area of the first arm operating valve 41 is set to be 700. Further, the aforementioned threshold ps1 is set to be 8, while the aforementioned threshold ps2 is set to be 140.

In the chart of FIG. 5, the opening area of the first arm operating valve 41 is set to be constant, and specifically, set to be the reference value of 700 regardless of the magnitude of the arm cylinder pressure Pca when the pilot pressure Ppb from the boom operating part 62 is zero, i.e., when the single operation is executed for the arm cylinder 25. Further, the opening area of the first arm operating valve 41 is set to be constant, and specifically, set to be the reference value of 700 regardless of the magnitude of the arm cylinder pressure Pca when the pilot pressure Ppb from the boom operating part 62 is less than or equal to the threshold of 8. Yet further, the opening area of the first arm operating valve 41 is set to be constant, and specifically, set to be the reference value of 700 regardless of the magnitude of the pilot pressure Ppb when the aim cylinder pressure Pca is greater than or equal to the threshold of 140. Putting them together, the opening area of the first arm operating valve 41 is set to be the same value as the opening area of that in executing the single operation (i.e., the reference value), either when the pilot pressure Ppb from the boom operating part 62 is less than or equal to the threshold of 8 or when the arm cylinder pressure Pca is greater than or equal to the threshold of 140.

The opening area of the first arm operating valve 41 is calculated based on the aforementioned equation (Equation 1) when the pilot pressure Ppb is greater than the threshold of 8 and the arm cylinder pressure Pca is less than the threshold of 140 (see an area enclosed by a dashed two-dotted line in FIG. 5). The herein calculated values of the opening area of the first arm operating valve 41 are less than the reference value of 700. The calculated values of the opening area of the first arm operating valve 41 get smaller in proportion to increase in the flow ratio r for the boom cylinder 24. Further, the calculated values of the opening area of the first arm operating valve 41 get larger in proportion to increase in the arm cylinder pressure Pca. In other words, the opening area of the first arm operating valve 41 is determined based on the arm cylinder pressure Pca.

The hydraulic excavator 10 is configured to calculate a value of the opening area of the first arm operating valve 41 based on the aforementioned equation (Equation 1) when the combined operation is executed for executing the arm excavation operation and the boom elevation operation. Further, the first and second pilot control valves 48 and 49 are configured to be controlled for regulating the opening area of the first arm operating valve 41 to be the value calculated based on the aforementioned equation (Equation 1). The first and second pilot control valves 48 and 49 are herein electromagnetic proportional control valves, and therefore, can accurately control the pilot pressure to the first arm operating valve 41 to be a predetermined value in response to a command signal from the control unit 30. In other words, the first arm operating valve 41 can be easily controlled to have the opening area of the value calculated based on the aforementioned equation (Equation 1).

Further, when the opening area of the first arm operating valve 41 is determined to be a value less than that in executing the single operation of the arm cylinder 25, the flow path of the first arm operating valve 41 is constricted than that in executing the single operation. Accordingly, the hydraulic fluid is allowed to easily flow to the boom cylinder 24. Thus, a sufficient amount of the hydraulic fluid can be reliably supplied to the boom cylinder 24.

Further, the opening area of the first arm operating valve 41 gets smaller in proportion to increase in the flow ratio r for the boom cylinder 24, i.e., in proportion to increase in the operating amount of the boom operating part 62. Therefore, the flow path of the first arm operating valve 41 is further constricted when the boom operating part 62 is operated by a large amount in response to demand for a large output of the boom cylinder 24. A large amount of the hydraulic fluid can be thereby reliably supplied to the boom cylinder 24. In other words, the opening area of the first arm operating valve 41 gets larger in proportion to reduction in the operating amount of the boom operating part 62. It is thereby possible to inhibit the flow path (i.e., the opening area) of the first arm operating valve 41 from being unnecessarily constricted without demand for a large output of the boom cylinder 24. Accordingly, hydraulic pressure loss can be reduced.

Further, the opening area of the first arm operating valve 41 gets larger in proportion to increase in the arm cylinder pressure Pca. Therefore, constriction of the flow path (i.e., the opening area) of the first arm operating valve 41 is inhibited or prevented when a large load is applied to the arm cylinder 25. It is thereby possible to inhibit the flow path (i.e., the opening area) of the first arm operating valve 41 from being unnecessarily constricted and prevent occurrence of hydraulic pressure loss. Yet further, increase in the pump pressure of the first hydraulic pump 31 can be inhibited by inhibiting or preventing constriction of the flow path (i.e., the opening area) of the first arm operating valve 41. It is thereby possible to inhibit reduction in the pump displacement of the first hydraulic pump 31. In other words, it is possible to inhibit slowdown of the action speeds of the arm cylinder 25 and the boom cylinder 24.

Further, the opening area of the first arm operating valve 41 is set to be the reference value when the pilot pressure from the boom operating part 62 is less than or equal to the threshold ps1. Therefore, constriction of the flow path of the first arm operating valve 41 is prevented when the operating lever 65 of the boom operating part 62 is slightly operated. Accordingly, it is possible to prevent the flow path of the first arm operating valve 41 from being sensitively constricted in response to the operation of the boom operating part 62 by even a small amount.

Further, the fixed value stored in the control unit 30 is used as the boom cylinder pressure when the opening area of the first arm operating valve 41 is calculated based on the aforementioned equation (Equation 1). Therefore, it is not necessary to provide a hydraulic pressure sensor for detecting the boom cylinder pressure. Yet further, load for the boom cylinder 24 less varies than that for the arm cylinder 25. Therefore, the arm cylinder pressure less varies. Consequently, it is possible to accurately calculate the appropriate opening area of the first arm operating valve 41 even when a fixed value is used as the arm cylinder pressure.

Further, a sufficient holding pressure cannot be ensured when the combined operation is executed for the working unit 13 in midair. Therefore, both of the arm cylinder pressure and the boom cylinder pressure may vary. Hunting may occur in the working unit 13 due to such hydraulic pressure variations. However, occurrence of hunting can be inhibited by using the fixed value as the boom cylinder pressure as described above.

Figure 6:
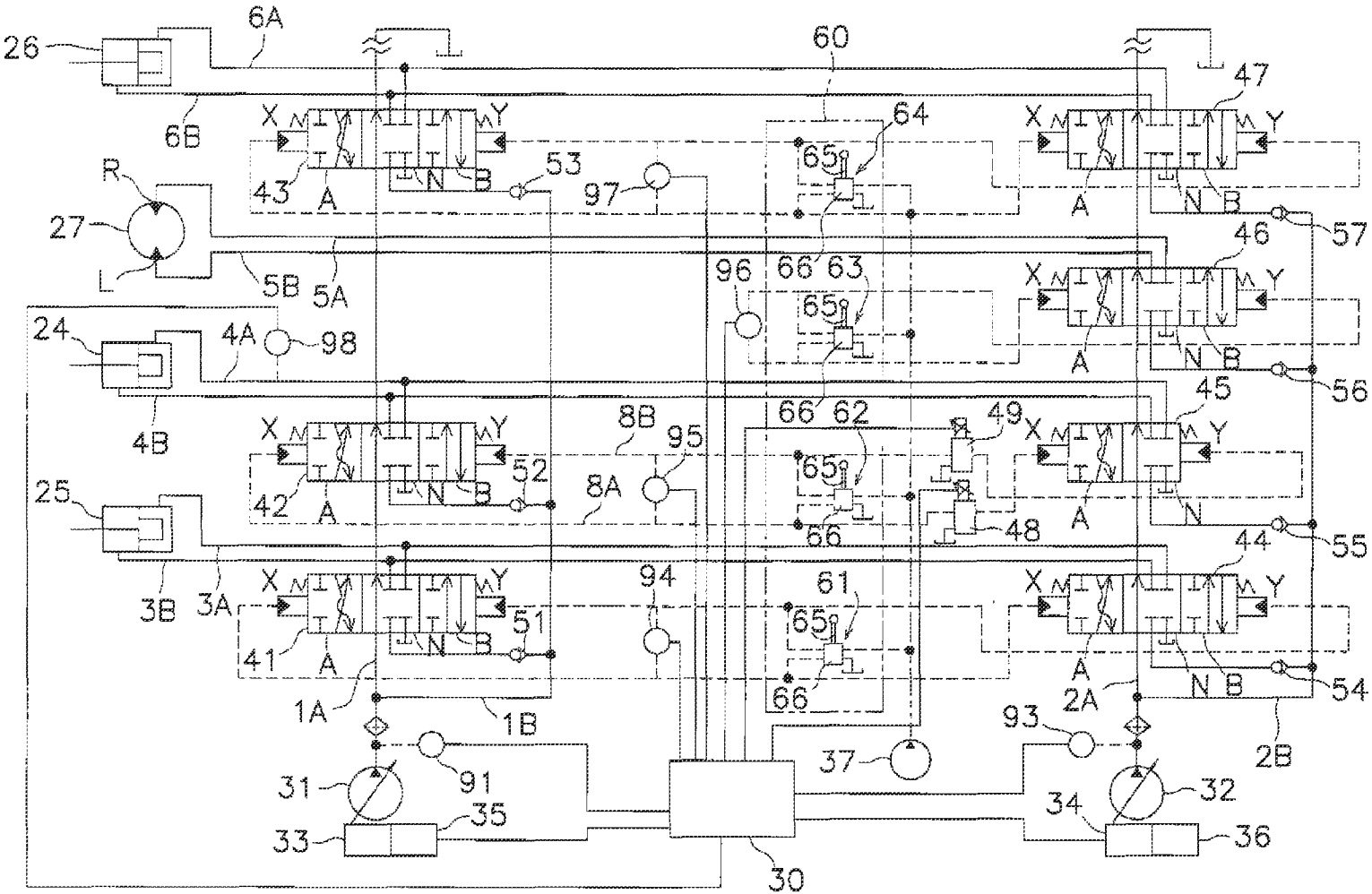
FIG. 6 is a schematic structure of a hydraulic circuit embedded in a hydraulic excavator according to another exemplary embodiment.

Other Embodiments (a) In the aforementioned exemplary embodiment, the arm cylinder 25 is used as the first actuator, while the boom cylinder 24 is used as the second actuator. However, any other actuators may be used as the first and second actuators. For example, the boom cylinder 24 may be used as the first actuator, while the revolving motor 27 may be used as the second actuator. In this case, the hydraulic circuit embedded in the hydraulic excavator 10 is preferably of a type represented in FIG. 6. In the hydraulic circuit, a first pilot control valve 48 is provided in a pilot flow path 8A, while a second pilot control valve 49 is provided in a pilot flow path 8B. The pilot flow paths 8A and 8B connect the second boom operating valve 45 and the pilot valve 66 of the boom operating part 62. Further, a hydraulic pressure sensor 98 is provided for detecting the pressure of the hydraulic fluid to be supplied to the bottom side oil chamber of the boom cylinder 24 (hereinafter referred to as "a boom cylinder pressure"). When the combined operation is executed for executing the boom elevation operation and the operation of the revolving motor 27, the opening area of the second boom operating valve 45 is determined in the same way as the aforementioned flow to be executed in the combined operation. Specifically, the opening area of the second boom operating valve 45 is herein configured to be calculated based on the following equation.

$$A = \frac{Q \times \frac{(10 - r)}{10}}{Ca \times \sqrt{Pcm - Pcb}} \qquad \text{Equation 2}$$

$$A = \frac{Q \times \frac{(10 - r)}{10}}{Ca \times \sqrt{Pcm - Pcb}}$$

In the above equation (Equation 2), "Q" represents the entire flow rate of the second hydraulic pump 32. "r" represents the flow ratio for the revolving motor 27 and is obtained from a flow ratio table. "Pcm" represents the pressure of the hydraulic fluid to be supplied to the revolving motor 27 (hereinafter referred to as "a revolving motor pressure") and a fixed value stored in the control unit 30 is used as "Pcm". "Pcb" represents the boom cylinder pressure detected by the hydraulic pressure sensor 98.

Similarly to the aforementioned exemplary embodiment, it is herein possible to prevent hydraulic pressure loss in the second hydraulic pump 32. Further, inhibition of reduction in the pump displacement of the second hydraulic pump 32 can prevent speed reduction of the boom cylinder 24 and the revolving motor 27.

Further, the present invention is applicable not only to the combined operation for two types of actuators but also to that for three or more types of actuators. In executing the combined operation for three types of actuators, it may be possible to execute a control of changing only the flow rate of one actuator and fixing the flow rates of two other actuators.

(b) In the aforementioned exemplary embodiment, the fixed value stored in the control unit 30 is used as the boom cylinder pressure. However, a hydraulic pressure sensor may be provided for detecting the boom cylinder pressure, and the hydraulic pressure detected by the hydraulic pressure sensor may be used as the boom cylinder pressure. Likewise, the revolving motor pressure in the aforementioned other exemplary embodiment (a) may be detected by a hydraulic pressure sensor. In this case, it is possible to further accurately calculate the opening area of the operating valve.

(c) In the aforementioned exemplary embodiment, the bucket 23 is used as a working attachment. However, any other working attachments such as a breaker may be used as a working attachment. Further, the present invention may be applied to any other work machines as long as they are configured to execute the combined operation for a plurality of actuators. Yet further, in the aforementioned exemplary embodiment, the present invention is applied to the hydraulic excavator so-called a backhoe with the attached bucket 23 faced to the cab 15. However, the present invention may be applied to so-called the loading shovels with the attached bucket 23 faced in the opposite direction to the cab 15.

(d) In the aforementioned exemplary embodiment, the opening area is configured to be calculated based on the equation. However, a value of the opening area may be determined based on a mapping. Specifically, the relation between the opening area and the hydraulic pressure may be preliminarily mapped and stored in the control unit, and the opening area may be determined based on a detected hydraulic pressure and the mapping.

The above described embodiments have an advantageous effect of inhibiting slowdown of action speeds of the actuators in executing the combined operation and occurrence of hydraulic pressure loss. Therefore, the present invention is useful as an invention of a work machine and an invention of a control method of the work machine.

The invention claimed is:

1. A work machine comprising:

a hydraulic pump configured to discharge a hydraulic fluid;

a first actuator configured to be driven by the hydraulic fluid discharged from the hydraulic pump;

a first direction switch valve configured to switch between directions of supplying the hydraulic fluid from the hydraulic pump, the first direction switch valve being configured to change an opening area of a flow path of the hydraulic fluid for changing a flow rate of the hydraulic fluid to be supplied to the first actuator;

a second actuator configured to be driven by the hydraulic fluid discharged from the hydraulic pump;

a second direction switch valve configured to switch between directions of supplying the hydraulic fluid from the hydraulic pump, the second direction switch valve being configured to change an opening area of a flow path of the hydraulic fluid for changing a flow rate of the hydraulic fluid to be supplied to the second actuator;

a first operating part configured to operate the first actuator;

a second operating part configured to operate the second actuator;

a first hydraulic pressure detector unit configured to detect a hydraulic pressure to be supplied to the first actuator, and a control unit configured to control the first direction switch valve such that the opening area of the first direction switch valve is set to a reference value during a single operation, and such that the opening area of the first direction switch valve is set to a value based on the hydraulic pressure detected by the first hydraulic pressure detector unit during execution of a combined operation, the combined operation representing an operation of simultaneously operating the first and second actuators, the single operation representing an operation of operating only the first actuator, the control unit being configured to set the opening area of the first direction switch valve to the reference value even during execution of the combined operation if the hydraulic pressure detected by the first hydraulic pressure detector unit is larger than or equal to a predetermined threshold, the control unit being configured to increase the opening area of the first direction switch valve in proportion to an increase in the hydraulic pressure detected by the first hydraulic pressure detector unit during execution of the combined operation while the hydraulic pressure detected by the first hydraulic pressure detector unit is smaller than the predetermined threshold.

2. The work machine according to claim 1, wherein the control unit is configured to determine a flow rate of the hydraulic fluid to be supplied to the first actuator and a flow rate of the hydraulic fluid to be supplied to the second actuator in accordance with the operating amount of the first operating part and an operating amount of the second operating part in executing the combined operation, the control unit being configured to set the opening area of the first direction switch valve to a valued determined based on the flow rate of the hydraulic fluid to be supplied to the first actuator, the hydraulic pressure detected by the first hydraulic pressure detector unit and the hydraulic pressure to be supplied to the second actuator.

3. The work machine according to claim 2, wherein the control unit is configured to use a fixed value preliminarily stored as a hydraulic pressure to be supplied to the second actuator in executing the combined operation.

4. The work machine according to claim 1, further comprising a vehicle body, a boom attached to the vehicle body, an arm attached to the boom, and a working attachment attached to the arm, the first actuator being configured to drive the arm, and the second actuator being configured to drive the boom.

5. The work machine according to claim 1, further comprising a vehicle body including a traveling unit and a revolving unit disposed on the traveling unit, a boom attached to the vehicle body, an arm attached to the boom, and a working attachment attached to the arm, the first actuator being configured to drive the boom, and the second actuator being configured to drive the revolving unit.

6. A method of controlling a work machine including: a hydraulic pump configured to discharge a hydraulic fluid; a first actuator configured to be driven by the hydraulic fluid discharged from the hydraulic pump; a first direction switch valve configured to switch between directions of supplying the hydraulic fluid from the hydraulic pump, the first direction switch valve being configured to change an opening area of a flow path of the hydraulic fluid for changing a flow rate of the hydraulic fluid to be supplied to the first actuator; a second actuator configured to be driven by the hydraulic fluid discharged from the hydraulic pump; a second direction switch valve being configured to switch between directions of supplying the hydraulic fluid from the hydraulic pump, the second direction switch valve configured to change an opening area of a flow path of the hydraulic fluid for changing a flow rate of the hydraulic fluid to be supplied to the second actuator; a first operating part configured to operate the first actuator; a second operating part configured to operate the second actuator; and a first hydraulic pressure detector unit configured to detect a hydraulic pressure to be supplied to the first actuator, the method comprising:

controlling the first direction switch valve such that the opening area of the first direction switch valve is set to a reference value during a single operation, and such that the opening area of the first direction switch valve is set to a value determined based on the hydraulic pressure detected by the first hydraulic pressure detector unit during execution of a combined operation, the combined operation representing an operation of simultaneously operating the first and second actuators, the single operation representing an operation of operating only the first actuator, setting the opening area of the first direction switch valve to the reference value even during a combined operation if the hydraulic pressure detected by the first hydraulic pressure detector unit is larger than or equal to a predetermined threshold, increasing the opening area of the first direction switch valve in proportion to an increase in the hydraulic pressure detected by the first hydraulic pressure detector unit during execution of the combined operation while the hydraulic pressure detected by the first hydraulic pressure detector unit is smaller than the predetermined threshold.

7. The work machine according to claim 1, wherein the control unit is further configured to set the opening area of the first direction switch valve to the reference value even during execution of the combined operation if the value determined based on the hydraulic pressure detected by the first hydraulic pressure detector unit exceeds the reference value.

* * * * *